US008150088B2

(12) United States Patent
Akino et al.

(10) Patent No.: US 8,150,088 B2
(45) Date of Patent: Apr. 3, 2012

(54) CONDENSER MICROPHONE

(75) Inventors: Hiroshi Akino, Tokyo (JP); Noriko Matsui, Tokyo (JP)

(73) Assignee: Kabushiki Kaisha Audio-Tecnica, Tokyo (JP)

( * ) Notice: Subject to any disclaimer, the term of this patent is extended or adjusted under 35 U.S.C. 154(b) by 1131 days.

(21) Appl. No.: 12/003,259

(22) Filed: Dec. 21, 2007

(65) Prior Publication Data

US 2008/0175412 A1 Jul. 24, 2008

(30) Foreign Application Priority Data

Dec. 28, 2006 (JP) ..... 2006-353719
Jan. 19, 2007 (JP) ..... 2007-009847

(51) Int. Cl.
*H04R 9/08* (2006.01)

(52) U.S. Cl. ..... 381/363; 381/361; 381/362; 381/189

(58) Field of Classification Search ..... 381/189, 381/355, 361, 362, 363, 365, 366, 368
See application file for complete search history.

(56) References Cited

U.S. PATENT DOCUMENTS

2006/0013426 A1* 1/2006 Akino ..... 381/361

FOREIGN PATENT DOCUMENTS

JP 11-341576 12/1999
JP 2006-33216 2/2006

* cited by examiner

*Primary Examiner* — Victor A Mandala
*Assistant Examiner* — Scott Stowe
(74) *Attorney, Agent, or Firm* — Manabu Kanesaka

(57) ABSTRACT

In a gooseneck condenser microphone that supports a condenser microphone unit via a support pipe, when the microphone is used by inserting a microphone cable through the support pipe in the state in which a shield covered wire having no skin is exposed throughout the entire length thereof, the movement of the microphone cable in the support pipe is restricted, by which the generation of noise caused by looseness contact of the shield covered wire with the inner wall of the support pipe is prevented. The microphone cable 40 is inserted through the support pipe in the state in which the shield covered wire 43 having no skin is exposed throughout the entire length thereof, and is provided with a conductive contact, in which the central part 51 thereof is held in a state of conducting with the shield covered wire 43, and wing pieces 52 on both sides are extended in the direction substantially perpendicular to the axis line of the microphone cable 40 so as to be in contact elastically with the inner surface of the support pipe, in the predetermined portion of the shield covered wire 43.

5 Claims, 6 Drawing Sheets

CONDENSER MICROPHONE

TECHNICAL FIELD

The present invention relates to a gooseneck condenser microphone that supports a condenser microphone unit via a support pipe including a flexible pipe, and a method for manufacturing the gooseneck condenser microphone. More particularly, it relates to a technique for preventing the generation of noise caused by high-frequency electromagnetic wave noise generated from a cellular phone etc.

BACKGROUND ART

As described in, for example, Patent Document 1 (Japanese Patent Application Publication No. H11-341576), a gooseneck condenser microphone is preferably used in conference facilities such as international conference rooms from the viewpoint of its simple appearance and ease of adjustment of the angle and height of the microphone.

In the gooseneck condenser microphone, a condenser microphone unit and an output module section are formed separately. The condenser microphone unit is supported on the output module section via a support pipe including a flexible pipe in whole or in part, so that the condenser microphone unit can easily be brought close to the mouth of a speaker by the flexibility of the flexible pipe.

Usually, the condenser microphone unit incorporates a field effect transistor (FET) serving as an impedance converter, and the output module section is provided with a circuit board having a sound signal output circuit and a power supply transformer in a cylindrical shield case. The condenser microphone unit is connected to the circuit board in the output module section via a dedicated microphone cable inserted through the support pipe.

The microphone cable includes a power wire for supplying power to the condenser microphone unit, a signal wire for giving sound signals, which are generated from the impedance converter, to the output module section, and a shielding covered wire that electrostatically shields the power wire and the signal wire and connects them to the ground. As the shielding covered wire, a two-core shielding covered wire the outer peripheral surface of which is covered with an external sheath (skin) is used. The output module section is sometimes called a power module section because it supplies power to the condenser microphone unit.

The microphone cable is vulnerable to noise (electromagnetic waves) coming from the outside because the sound signals are transmitted unbalancedly. Therefore, if strong electromagnetic waves are applied to the microphone cable, the electromagnetic waves intrude into the condenser microphone unit and the output module section, being detected by a semiconductor device etc., and therefore noise is sometimes generated.

In particular, a cellular phone that has come into wide use rapidly in recent years generates considerably strong electromagnetic waves (for example, within the range of about several centimeters to several tens centimeters, a field intensity reaching tens of thousands times of field intensity produced in the city by commercial electric waves). Therefore, in the field of microphone, measures against electromagnetic waves caused by cellular phones are urgently needed.

The flexible pipe functions as a shield for the microphone cable, but this function is not complete. Specifically, the flexible pipe is manufactured by forming a coil spring, which exerts a restoring force, by a round wire rod formed of steel etc. and by inserting a triangular wire rod formed of a copper alloy, which has a triangular cross-sectional shape and is plastically deformed, into the gap of the coil springs from above, so that the contact portion of these wire rods has impedance though the resistance value is low (for example, about 1Ω).

The condenser microphone unit and the output module section each have a sure shield case. However, when viewed as the entire of microphone, the shield in the portion of the flexible pipe is incomplete. Therefore, strong electromagnetic waves intrude into the microphone through the flexible pipe, and resultantly noise may be generated as described above.

To solve this problem, the applicant of the present invention has proposed, in Patent Document 2 (Japanese Patent Application Publication No. 2006-33216), a technique in which the microphone cable is inserted through the flexible pipe in the state in which the shield covered wire having no skin is exposed, and the shield covered wire is brought into contact with the inner surface of the flexible pipe at many points.

According to the invention described in Patent Document 2, the resistance value of the flexible pipe is very low, and the shielding function against electromagnetic waves is improved significantly, whereby the generation of noise can be restrained effectively. However, problems to be solved still remain.

Since the gooseneck condenser microphone is mainly used in a conference room or the like, the length of the support pipe must be increased considering a case where the speaker uses the microphone in a standing-up state. In this case, if the whole of the support pipe is formed by the flexible pipe, it bends excessively, so that the appearance is bad. Therefore, a nonflexible metallic pipe is usually used in a portion in which the length is increased.

However, in the metallic pipe, the shield covered wire of the microphone cable is not always in contact with the inner wall of the metallic pipe. Therefore, for example, when the tilt of the support pipe is changed, loud noise may be generated when the shield covered wire comes into contact with the inner wall of metallic pipe because of looseness of the microphone cable in the metallic pipe (in this specification, this contact is referred to as "looseness contact").

This noise may also be generated in the case where the microphone cable moves and the shield covered wire comes into contact with the inner wall of the flexible pipe when the flexible pipe is bent, for example, in the state in which the support pipe is made straight, and the shield covered wire of the microphone cable is not in contact with the inner wall of the flexible pipe.

Accordingly, an object of the present invention is to prevent the generation of noise caused by the looseness contact of a shield covered wire with the inner wall of a support pipe by restricting the movement of a microphone cable in the support pipe when the microphone cable is used by being inserted through the support pipe in the state in which the shield covered wire having no skin is exposed throughout the entire length in a gooseneck condenser microphone that supports a condenser microphone unit via the support pipe including a flexible pipe.

SUMMARY OF THE INVENTION

To achieve the above object, the present invention provides a condenser microphone including a condenser microphone unit and an output module section provided with a circuit board for producing sound signals in a shield case, the condenser microphone unit being supported on the output module section via a support pipe including a flexible pipe, and the condenser microphone unit and the circuit board being electrically connected to each other via a microphone cable having a shield covered wire inserted through the support pipe, wherein the microphone cable is inserted through the support pipe in a state in which the shield covered wire having no skin is exposed throughout the entire length thereof, and is provided with a conductive contact, in which the central part thereof is held in a state of conducting with the shield covered wire, and wing pieces on both sides are extended in the direction substantially perpendicular to the axis line of the microphone cable so as to be in contact elastically with the inner surface of the support pipe, in the predetermined portion of the shield covered wire.

According to this mode, since the microphone cable is inserted through the support pipe in the state in which the shield covered wire having no skin is exposed throughout the entire length thereof, and is provided with the conductive contact, in which the central part thereof is held in a state of conducting with the shield covered wire, and the wing pieces on both sides are extended in the direction substantially perpendicular to the axis line of the microphone cable so as to be in contact elastically with the inner surface of the support pipe, in the predetermined portion of the shield covered wire, the movement of the microphone cable in the support pipe is restricted while the shield covered wire of the microphone cable is brought into contact with the inner surface of the support pipe at many points. Therefore, the shielding function against electromagnetic waves is improved significantly, and also the generation of noise caused by looseness contact of the shield covered wire with the inner wall of the support pipe can be prevented.

As a further preferable mode, the contact consists of a conductive cloth having elasticity.

According to this mode, since the conductive cloth having elasticity is used as the contact, the contact can be cut into an arbitrary shape, and also can be obtained at a relatively low cost.

Also, the support pipe includes a nonflexible metallic pipe, and the contact is attached to the shield covered wire in a portion corresponding to the metallic pipe at a predetermined interval.

According to this mode, in the case where the support pipe includes the nonflexible metallic pipe, the contact is attached to the shield covered wire in the portion corresponding to the metallic pipe at a predetermined interval, so that the generation of noise especially in the metallic pipe portion can be prevented effectively.

Further, the shield covered wire consists of a braided wire, and the central part of the contact is caused to creep into the braided wire.

According to this mode, since the shield covered wire consists of the braided wire, and the central part of the contact is caused to creep into the braided wire, the contact can easily be attached to the shield covered wire without the use of an electrical or mechanical means such as a conductive adhesive.

As a further preferable mode, the contact is formed into a substantially rhombic shape such that the central part has the maximum width and the width decreases gradually toward the tip ends of wing pieces on both sides.

According to this mode, since the contact is formed into a substantially rhombic shape such that the central part has the maximum width and the width decreases gradually toward the tip ends of the wing pieces on both sides, in the case where the shield covered wire consists of the braided wire, the contact can easily be caused to creep into the braided wire.

Also, to achieve the above object, the present invention provides a condenser microphone including a condenser microphone unit and an output module section provided with a circuit board for producing sound signals in a shield case, the condenser microphone unit being supported on the output module section via a support pipe including a flexible pipe, and the condenser microphone unit and the circuit board being electrically connected to each other via a microphone cable having a shield covered wire inserted through the support pipe, wherein the microphone cable is inserted through the support pipe in the state in which the shield covered wire having no skin is exposed throughout the entire length thereof, and in the predetermined portion of the shield covered wire, an elastic linear body which is formed by plantingly providing fibers in the radial direction around a core wire and has elasticity in the radial direction due to the fibers is provided along the microphone cable, whereby the predetermined portion of the shield covered wire is pressed against the inner surface of the support pipe by the elastic linear body.

According to this mode, since the microphone cable is inserted through the support pipe in the state in which the shield covered wire having no skin is exposed throughout the entire length thereof, and in the predetermined portion of the shield covered wire, an elastic linear body which is formed by plantingly providing fibers in the radial direction around a core wire and has elasticity in the radial direction due to the fibers is provided along the microphone cable, whereby the predetermined portion of the shield covered wire is pressed against the inner surface of the support pipe by the elastic linear body, the shield covered wire is in firm contact with the inner surface of the support pipe, so that the shielding function against electromagnetic waves is improved significantly, and also the movement of the microphone cable in the support pipe is restricted. Therefore, the generation of noise caused by looseness contact of the shield covered wire with the inner wall of the support pipe can be prevented.

As a further preferable mode, the support pipe includes a nonflexible metallic pipe, the elastic linear body consists of a braid in which the core wire is formed of a wire material, and the braid is provided along the shield covered wire in a portion corresponding to the metallic pipe.

According to this mode, in the case where the support pipe includes the nonflexible metallic pipe, the braid in which the core wire is formed of a wire material is used as the elastic linear body and is provided along the shield covered wire in the portion corresponding to the metallic pipe, so that the generation of noise especially in the metallic pipe portion can be prevented effectively. Also, since the braid can be obtained easily at a low cost, the increase in cost can be kept at a minimum.

Also, the end part of the wire material is projected from at least one end of the braid, and the braid is attached to the predetermined position of the shield covered wire by winding the end part of the wire material on the shield covered wire.

According to this mode, since the end part of the wire material is projected from at least one end of the braid, and the end part thereof is wound on the shield covered wire, the braid can easily be attached to the predetermined position of the shield covered wire.

Further, the elastic linear body consists of a braid yarn in which the core wire is a core yarn, and the braid yarn is provided along the shield covered wire throughout almost the entire length of the microphone cable.

According to this mode, since the braid yarn in which the core wire is a core yarn is used as the elastic linear body, and the braid yarn is provided along the shield covered wire throughout almost the entire length of the microphone cable, the movement of the microphone in the support pipe is restricted, so that the generation of noise caused by looseness contact of the shield covered wire with the inner wall of the support pipe can be prevented.

As a further preferable mode, the fibers planting provided around the core wire have electric conductivity.

According to this mode, since the fibers planting provided around the core wire have electric conductivity, the generation of noise caused by looseness contact of the shield covered wire with the inner wall of the support pipe can be prevented, and also since the shield covered wire is in electrical contact with the inner surface of the support pipe via the conductive fibers, the shielding function against electromagnetic waves can be improved significantly.

Also, to achieve the above object, the present invention provides a condenser microphone including a condenser microphone unit and an output module section provided with a circuit board for producing sound signals in a shield case, the condenser microphone unit being supported on the output module section via a support pipe including a flexible pipe, and the condenser microphone unit and the circuit board being electrically connected to each other via a microphone cable having a shield covered wire inserted through the support pipe, wherein the microphone cable is inserted through the support pipe in the state in which the shield covered wire having no skin is exposed throughout the entire length thereof, and around the predetermined portion of the shield covered wire, a spacer which holds the shield covered wire in a noncontact state with respect to the support pipe is provided.

According to this mode, since the microphone cable is inserted through the support pipe in the state in which the shield covered wire having no skin is exposed throughout the entire length thereof, and around the predetermined portion of the shield covered wire, the spacer which holds the shield covered wire in a noncontact state with respect to the support pipe is provided, the generation of noise caused by looseness contact of the shield covered wire with the inner wall of the support pipe can be prevented.

As a further preferable mode, the support pipe includes a nonflexible metallic pipe, and the spacer is attached to the shield covered wire in a portion corresponding to the metallic pipe at a predetermined interval.

According to this mode, in the case where the support pipe includes a nonflexible metallic pipe, the spacer is attached to the shield covered wire in the portion corresponding to the metallic pipe at a predetermined interval, so that the generation of noise especially in the metallic pipe portion can be prevented effectively.

Also, the spacer consists of an expandable ink material the volume of which is increased by heating.

According to this mode, since the expandable ink material the volume of which is increased by heating is used as the spacer, the spacer can easily be provided at a predetermined location.

Also, to achieve the above object, the present invention provides a method for manufacturing a condenser microphone including a condenser microphone unit and an output module section provided with a circuit board for producing sound signals in a shield case, the condenser microphone unit being supported on the output module section via a support pipe including a flexible pipe, and the condenser microphone unit and the circuit board being electrically connected to each other via a microphone cable having a shield covered wire inserted through the support pipe, wherein after the microphone cable has been made in the state in which the shield covered wire having no skin is exposed throughout the entire length thereof, and has been inserted through the support pipe by applying an expandable ink material the volume of which is increased by heating to around the predetermined portion of the shield covered wire, the expandable ink material is heated to increase the volume thereof, by which the predetermined portion of the shield covered wire is held in a noncontact state with respect to the support pipe.

According to this mode, in the method for manufacturing a condenser microphone, after the microphone cable has been made in the state in which the shield covered wire having no skin is exposed throughout the entire length thereof, and has been inserted through the support pipe by applying the expandable ink material the volume of which is increased by heating to around the predetermined portion of the shield covered wire, the expandable ink material is heated to increase the volume thereof, by which the predetermined portion of the shield covered wire is held in a noncontact state with respect to the support pipe. Thereby, the condenser microphone in which the movement of the microphone cable in the support pipe is restricted, and thereby the generation of noise caused by looseness contact of the shield covered wire is prevented can be manufactured with high productivity.

As a further preferable mode, the support pipe includes a nonflexible metallic pipe, and the expandable ink material is applied to the shield covered wire in a portion corresponding to the metallic pipe at a predetermined interval.

According to this mode, in the method for manufacturing a condenser microphone, in the case where the support pipe includes a nonflexible metallic pipe, the expandable ink material is applied to the shield covered wire in the portion corresponding to the metallic pipe at a predetermined interval, so that the condenser microphone in which noise is not generated especially in the metallic pipe portion can be manufactured with high productivity.

DETAILED DESCRIPTION

Figure 1:
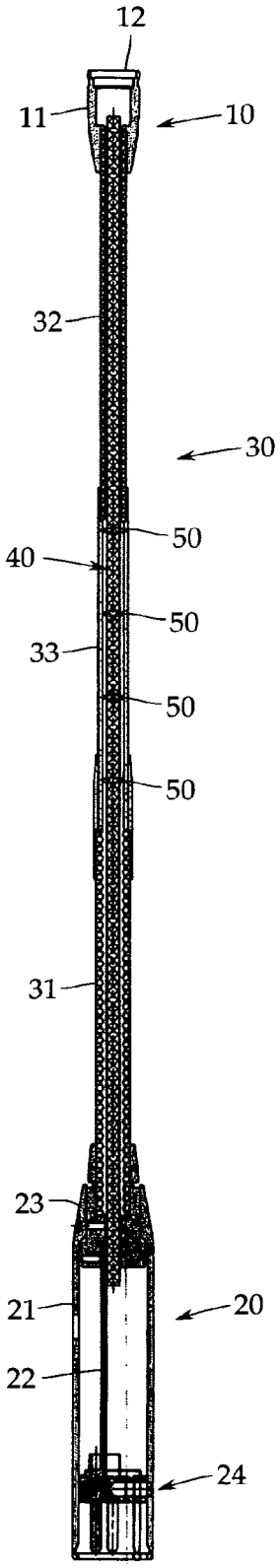
FIG. 1 is a sectional view of a gooseneck condenser microphone in accordance with a first embodiment of the present invention.
Figure 2:
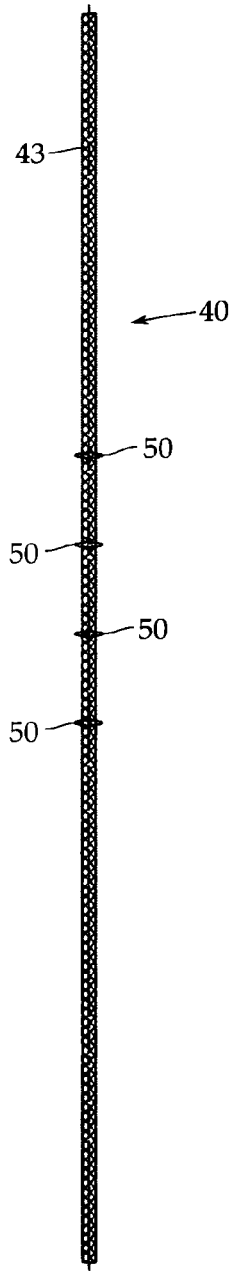
FIG. 2 is a front view of a microphone cable in a first embodiment.
Figure 3:
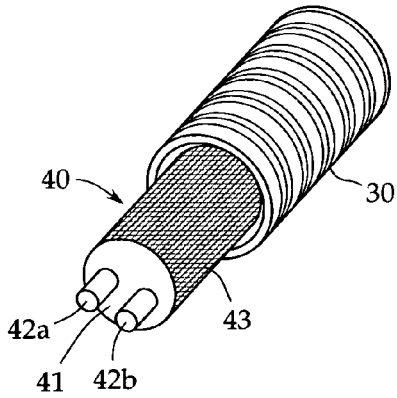
FIG. 3 is a perspective view showing a part of the microphone cable shown FIG. 2.
Figure 4:
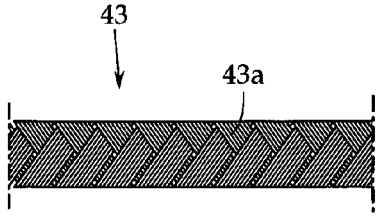
FIG. 4 is a schematic view showing that a shield covered wire of the microphone cable shown in FIG. 2 is a braided wire.
Figure 5:
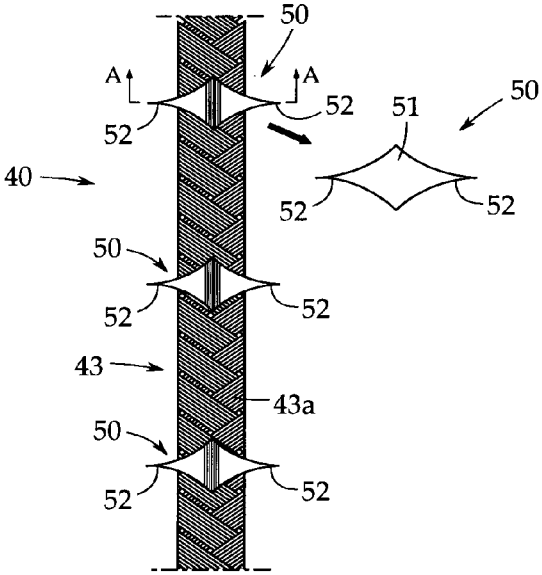
FIG. 5 is an enlarged front view showing a state in which contacts are attached to the shield covered wire shown in FIG. 4.
Figure 6:
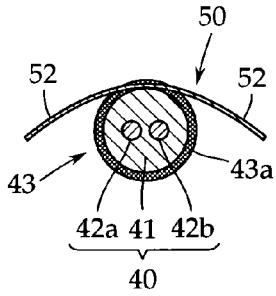
FIG. 6 is a sectional view taken along the line A-A of FIG. 5.
Figure 7A:
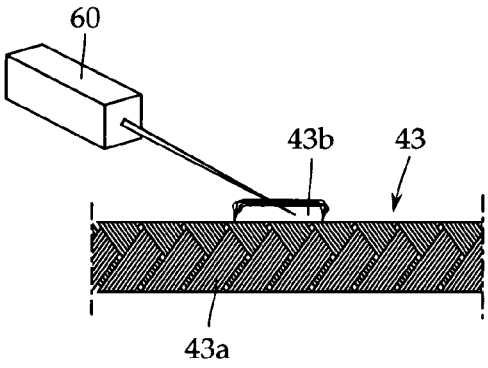
FIG. 7A is a schematic view for explaining a work procedure for attaching a contact to the shield covered wire shown in FIG. 4.
Figure 7B:
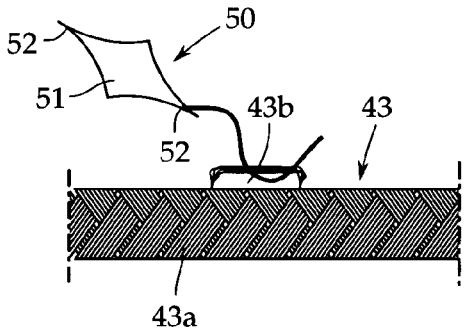
FIG. 7B is a schematic view for explaining a work procedure for attaching a contact to the shield covered wire shown in FIG. 4.

First, a first embodiment of the present invention is explained by reference to FIGS. 1 to 7. FIG. 1 is a sectional view of a gooseneck condenser microphone in accordance with the first embodiment of the present invention, FIG. 2 is a front view of a microphone cable drawn out of the gooseneck condenser microphone shown in FIG. 1, FIG. 3 is a perspective view showing a part of the microphone cable, FIG. 4 is a schematic view showing that a shield covered wire of the microphone cable is a braided wire, FIG. 5 is an enlarged front view showing the state in which contacts are attached to the shield covered wire, which is an essential portion of the first embodiment, FIG. 6 is a sectional view taken along the line A-A of FIG. 5, and FIGS. 7A and 7B are schematic views for explaining a work procedure for attaching the contact to the shield covered wire.

As shown in FIG. 1, a condenser microphone in accordance with the first embodiment includes, as a basic configuration, a condenser microphone unit 10, an output module section (power module section) 20, and a support pipe 30 that supports the condenser microphone unit 10.

The condenser microphone unit 10 has a cylindrical shield case 11 formed of, for example, a brass material, and a microphone capsule 12 is mounted in the tip end part of the shield case 11.

Although not shown in the figures, in the microphone capsule 12, an electrostatic acoustoelectric converter consisting of a diaphragm and a backplate arranged opposedly via a spacer ring is included. As a polarization material, an electret may be used. Although not shown in the figures similarly, in the shield case 11, a field effect transistor (FET) serving as an impedance converter connected electrically to the backplate is housed.

The output module section 20 has a cylindrical shield case 21 that is also used as a support base. This shield case 21 is also formed of a conductive material such as brass. In the shield case 21, a circuit board 22 having a sound output circuit, not shown, including a filter circuit, an amplification circuit, a power supply transformer, and the like is housed. The shield case 21 is installed on a table via a suitable receiving member or the like.

On one end side (the upper end side in this example) of the shield case 21, a connector 23 for fixedly fitting the support pipe 30 is provided. On the other end side (the lower end side in this example) of the shield case 21, an output connector 24 is mounted.

In the condenser microphone, usually, as the output connector 24, a three-pin type output connector specified in EIAJ RC-5236 "Latch lock type round connector for audio equipment" is used, and the output connector 24 is connected to a phantom power source via a balanced shielded cable (both elements are not shown in the figures).

For the support pipe 30, a flexible pipe may be used throughout the entire length of the support pipe 30. In this example, however, to increase the length of the support pipe 30 considering a case where the speaker uses the microphone in a standing-up state, the support pipe 30 is configured so that two flexible pipes of a base-side flexible pipe 31 and a tip end-side flexible pipe 32 are connected to each other by a metallic pipe 33 for increasing the length of the support pipe 30.

In this example, the base-side flexible pipe 31 has a diameter larger than that of the tip end-side flexible pipe 32 to meet the design requirement. Both of the flexible pipes 31 and 32 are manufactured by forming a coil spring, which exerts a restoring force, by a round wire rod formed of steel etc. and by inserting a triangular wire rod formed of a copper alloy, which has a triangular cross-sectional shape and is plastically deformed, into the gap of the coil springs from above. Therefore, the flexible pipes 31 and 32 can be deformed at any position because the round wire rod and the triangular wire rod create great friction, and self-hold the deformed state.

In the support pipe 30, a microphone cable 40 for electrically connecting the condenser microphone unit 10 and the output module section 20 to each other is inserted.

As shown in FIG. 3, the microphone cable 40 consists of a two-core shield covered wire, and includes a power wire 42*a* and a signal wire 42*b*, which are inserted in an internal sheath 41, and a shield covered wire 43 wound around the whole of the outer peripheral surface of the internal sheath 41.

For the cable having the shield covered wire, not limited to the microphone cable, the entire length of the shield covered wire is covered with an external sheath (skin). In the present invention, however, as shown in FIG. 2, for the microphone cable 40, the external sheath is removed throughout the entire length thereof, and the shield covered wire 43 is exposed.

According to this configuration, the shield covered wire 43 of the microphone cable 40 connects electrically with the inner surface of the flexible pipes 31 and 32 at many points, so that the resistance values of the flexible pipes 31 and 32 are small. Therefore, the shield in the portions of the flexible pipes 31 and 32 can be strengthened.

In the portion of the metallic pipe 33, the microphone cable 40 is inserted with some degree of looseness. Therefore, for example, when the support pipe 30 is tilted, the microphone cable 40 moves in the metallic pipe 33 and comes into contact with the inner wall of the metallic pipe 33 (looseness contact), by which loud noise may be generated.

To prevent this generation of noise, in the first embodiment, a contact 50 is attached to the microphone cable 40 to prevent the movement of the microphone cable 40 in the support pipe 30. In this example, as shown in FIG. 2, the contact 50 is provided at four locations at predetermined intervals in the portion in which the microphone cable 40 is inserted through the metallic pipe 33.

The contact 50 may be attached to the shield covered wire 43 with a conductive adhesive or the like. In the case where the shield covered wire 43 consists of a braided wire 43*a* as shown in FIG. 4, the contact 50 can be attached by causing a part of the contact 50 to creep into the braided wire 43*a*. FIG. 5 shows a state in which the contacts 50 are attached, and FIG. 6 shows a cross section taken along the line A-A of FIG. 5.

The material for the contact 50 is required to have high electric conductivity and suitable elasticity, to have a smooth surface so as to slip with respect to the inner wall of the metallic pipe 33, to be easily formed into a predetermined shape, and additionally to be easily attached to the braided wire 43*a* of the shield covering.

As the material that meets such requirements, a conductive cloth is preferable. As the conductive cloth of this type, for example, nonwoven conductive cloth NW-50-PCN (product number) manufactured by ESD EMI Corporation is available.

In the first embodiment, as shown in FIG. 5, the contact 50 formed by a conductive cloth is formed into a substantially rhombic shape such that a central part 51 has the maximum width and the width decreases gradually toward the tip ends of wing pieces 52 on both sides.

The contact 50 is held by the shield covered wire 43 so as to creep into the braided wire 43*a* of the shield covering, and is extended in the direction substantially perpendicular to the axis line of the microphone cable 40 so that the wing pieces 52 on both sides come into contact elastically with the inner surface of the metallic pipe 33. Thereby, the movement of the microphone cable 40 in the metallic pipe 33 is restricted, and thus the generation of noise caused by looseness contact is prevented.

To attach the contact 50 to the shield covered wire 43, as shown in FIG. 7A, a drill-shaped tool 60 such as an eyeleteer is stuck into the braided wire 43*a* of the shield covering and is moved to the right and left to form a gap 43*b* corresponding to the width of the central part 51 of the contact 50. Thereafter, as shown in FIG. 7B, the contact 50 is inserted through the gap 43*b* to cause the central part 51 to creep into the braided wire 43*a* of the shield covering, and the gap 43*b* is crushed by a finger etc. to fix the contact 50.

Thus, in causing the contact 50 to creep into the braided wire 43*a* of the shield covering, it is preferable that the contact 50 have a rhombic shape. In some cases, however, the contact 50 may have a rectangular or elliptical shape.

The length of the wing piece 52 may be determined appropriately considering the inside diameter of the metallic pipe 33 and the outside diameter of the microphone cable 40 and other factors on condition that the wing piece 52 have a length such that the wing piece 52 can come into contact with the inner wall of the metallic pipe 33. As one example, the length of each of the wing pieces 52 may be a length corresponding to the semicircle length of the microphone cable 40.

Also, in the first embodiment, the contacts 50 are provided only in the portion in which the microphone cable 40 is inserted through the metallic pipe 33. However, the contacts 50 may also be provided in the portions in which the microphone cable 40 is inserted through the flexible pipes 31 and 32.

Figure 8:
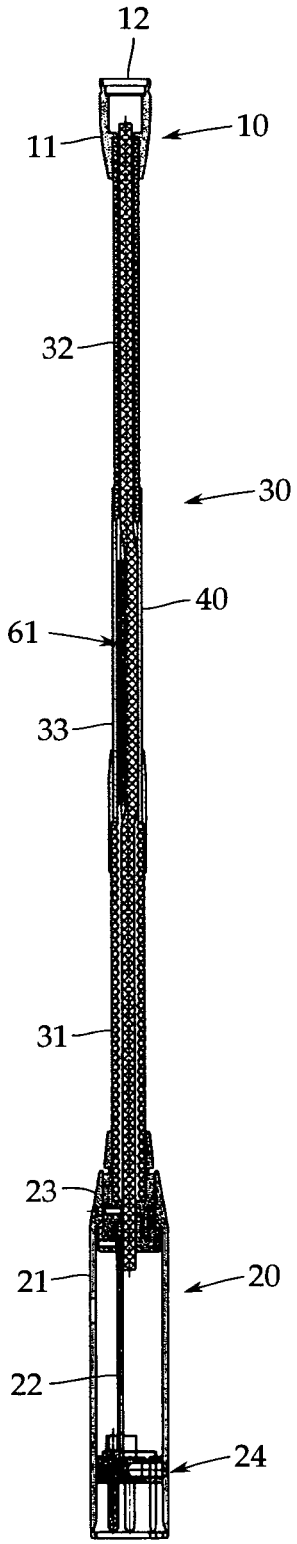
FIG. 8 is a sectional view of a gooseneck condenser microphone in accordance with a second embodiment of the present invention.
Figure 9:
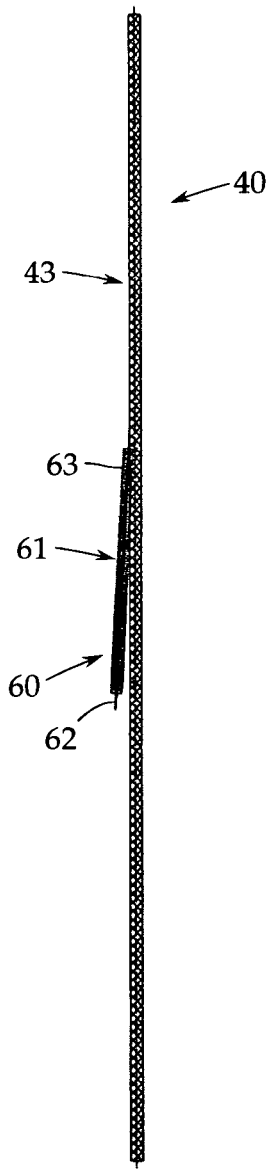
FIG. 9 is a front view of a microphone cable in a second embodiment.

Next, a second embodiment of the present invention is explained by reference to FIGS. 8 and 9. FIG. 8 is a sectional view of a gooseneck condenser microphone in accordance with the second embodiment of the present invention, and FIG. 9 is a front view of a microphone cable drawn out of the gooseneck condenser microphone shown in FIG. 8. FIGS. 8 and 9 correspond to FIGS. 1 and 2 of the above-described first embodiment, and in FIGS. 8 and 9, the same reference numerals are applied to elements that are the same as those in the first embodiment, and detailed explanation thereof is omitted.

In the second embodiment as well, as shown in FIGS. 8 and 9, the microphone cable 40 is inserted through the support pipe 30 in the state in which the external sheath is removed throughout the entire length thereof and the shield covered wire 43 is exposed. To prevent the generation of noise caused by looseness contact by restricting the movement of the microphone cable 40 in the support pipe 30, a braid 61 is used as an elastic linear body 60 that is formed by plantingly providing fibers in the radial direction around a core wire and has elasticity in the radial direction due to the fibers.

The braid 61 is a string formed by plantingly providing fibers 63, which are formed of, for example, nylon, in the radial direction around the wire 62, which is the core wire, by holding the fibers 63 between the wires 62 and twisting them, and has elasticity in the radial direction because the fibers 63 are fluffy. This braid may be a commercially available braid that is used, for example, for binding a package bag or cleaning a tobacco pipe.

In this example, to prevent the generation of noise caused by looseness contact especially in the metallic pipe 33 of the support pipe 30, the length of the braid 61 is set at a length that is almost the same as the length of the metallic pipe 33, and, as shown in FIG. 9, the braid 61 is provided along the shield covered wire 43 in the portion in which the microphone cable 40 is caused to pass through in the metallic pipe 33.

In this case, the end part of the wire 62 is projected from at least one end of the braid 61, and is wound on the shield covered wire 43. Thereby, the braid 61 can easily be attached to the predetermined position of the shield covered wire 43.

According to this configuration, when the microphone cable 40 is inserted through the support pipe 30, as shown in FIG. 8, the microphone cable 40 is surely pushed against the inner surface of the metallic pipe 33 by the elastic force of the braid 61 in the metallic pipe 33. Therefore, the movement of the microphone cable 40 is restricted, and thus the generation of noise caused by looseness contact can be prevented effectively.

Also, since the shield covered wire 43 comes into electrical contact properly with the inner surface of the metallic pipe 33, the shielding function against electromagnetic waves is improved significantly. By using conductive fibers as the fibers 63 plantingly provided on the braid 61, the shielding function can further be increased.

Also, depending on the wire diameter of the braid 61, in some cases, the braid 61 may be provided throughout the entire length of the microphone cable 40. Alternatively, the braid 61 may be provided along the microphone cable 40 at a plurality of locations at predetermined intervals.

Figure 10:
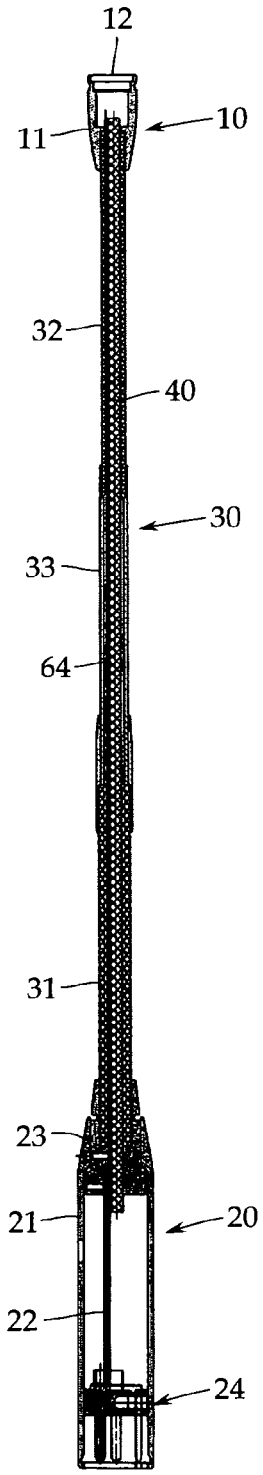
FIG. 10 is a sectional view of a gooseneck condenser microphone in accordance with a third embodiment of the present invention.
Figure 11:
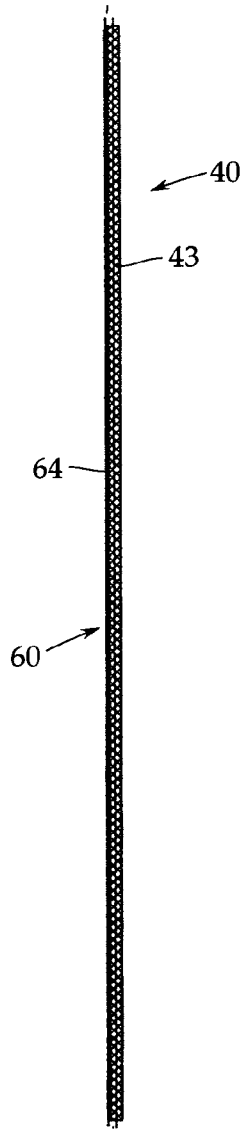
FIG. 11 is a front view of a microphone cable in a third embodiment.

Next, a third embodiment of the present invention is explained by reference to FIGS. 10 and 11. FIG. 10 is a sectional view of a gooseneck condenser microphone in accordance with the third embodiment of the present invention, and FIG. 11 is a front view of a microphone cable drawn out of the gooseneck condenser microphone shown in FIG. 10. FIGS. 10 and 11 correspond to FIGS. 1 and 2 of the above-described first embodiment, and in FIGS. 10 and 11, the same reference numerals are applied to elements that are the same as those in the first embodiment, and detailed explanation thereof is omitted.

In the third embodiment as well, to prevent the generation of noise caused by looseness contact by restricting the movement of the microphone cable 40, in which the shield covered wire 43 is exposed, in the support pipe 30, as in the second embodiment, the elastic linear body 60 that is formed by plantingly providing fibers in the radial direction around the core wire and has elasticity in the radial direction due to the fibers is used. In the third embodiment, however, the elastic linear body 60 consists of a braid yarn 64. The braid yarn 64 differs from the braid 61 in that as the core wire, a core yarn and a pressing yarn are used instead of the wire.

Although the details are not shown in the figures, the braid yarn 64 is a yarn such that when the core yarn and the pressing yarn are twisted, a fiber called a filament is held therebetween. Like the braid 61, the braid yarn 64 has elasticity in the radial direction because the fibers are fluffy. The braid yarn 64 may be a commercially available braid yarn that is used as a material for clothing, bags, and the like.

In the third embodiment, as shown in FIG. 11, the braid yarn 64 is inserted through the support pipe 30 together with the microphone cable 40 as shown in FIG. 10 in a state of being provided throughout the entire length of the exposed shield covered wire 43 of the microphone cable 40.

According to this configuration, as in the second embodiment, the microphone cable 40 is pushed against the inner surface of the support pipe 30 by the elasticity in the radial direction due to the fluffy fibers of the braid yarn 64, so that the movement of the microphone cable 40 is restricted, and thus the generation of noise caused by looseness contact can be prevented effectively. To increase the shielding function, it is preferable that the fibers of the braid yarn 64 be made conductive fibers.

Figure 12:
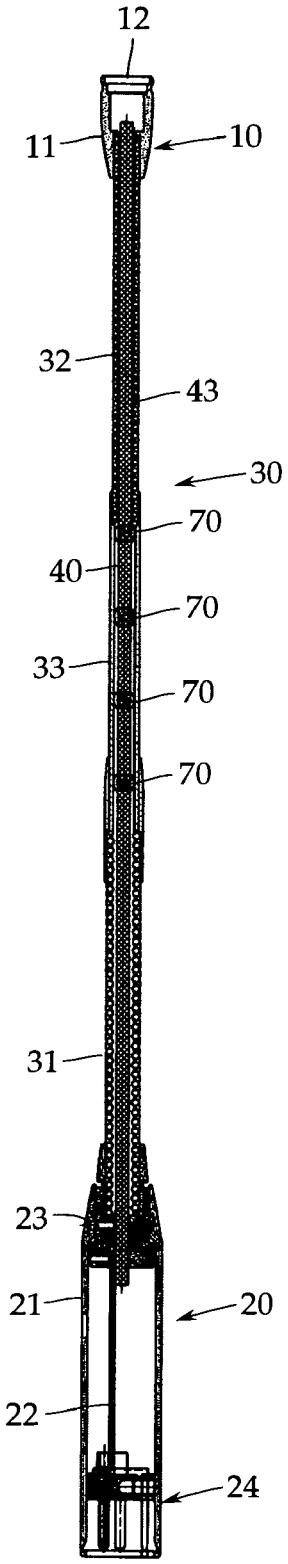
FIG. 12 is a sectional view of a gooseneck condenser microphone in accordance with a fourth embodiment of the present invention.
Figure 13:
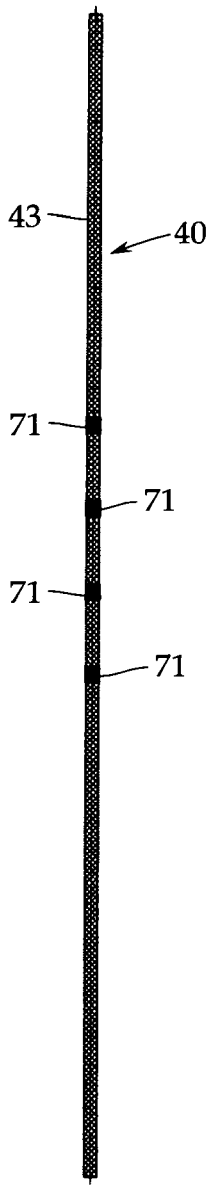
FIG. 13 is a front view of a microphone cable in a fourth embodiment.

Next, a fourth embodiment of the present invention is explained by reference to FIGS. 12 and 13. FIG. 12 is a sectional view of a gooseneck condenser microphone in accordance with the fourth embodiment of the present invention, and FIG. 13 is a front view of a microphone cable drawn out of the gooseneck condenser microphone shown in FIG. 1. FIGS. 12 and 13 correspond to FIGS. 1 and 2 of the above-described first embodiment, and in FIGS. 12 and 13, the same reference numerals are applied to elements that are the same as those in the first embodiment, and detailed explanation thereof is omitted.

In the fourth embodiment, to prevent the generation of noise caused by looseness contact by restricting the movement of the microphone cable 40, in which the shield covered wire 43 is exposed, in the support pipe 30, as shown in FIG. 12, spacers 70 are provided around the predetermined portions of the shield covered wire 43 of the microphone cable 40 to hold the shield covered wire 43 in a noncontact state with respect to the support pipe 30.

As the spacer 70, a synthetic resin-made or metal-made ring may be fitted on the shield covered wire 43. However, from the viewpoint of productivity, cost, and the like, it is preferable that an expandable ink material the volume of which is increased by heating be used.

The expandable ink material is a special ink that is expanded like a bubble and solidified by heating while bubbles are contained in the ink. Usually, the expandable ink material is used as a print material for clothing etc. For example, the expandable ink material published on the Internet website of Silk Master Co., Ltd. is available.

In this example, to prevent the generation of noise caused by looseness contact especially in the metallic pipe 33 of the support pipe 30, as shown in FIG. 13, expandable ink materials 71 are applied in advance at several locations (four locations in this example) at predetermined intervals around the portion in which the shield covered wire 43 is caused to pass through in the metallic pipe 33.

After the microphone cable 40 has been inserted through the support pipe 30, the expandable ink materials 71 are expanded by heating, by which the spacers 70 are formed by means of the expandable ink materials 71 as shown in FIG. 12.

The expandable ink materials 71 may be applied over the whole of the portion of the shield covered wire 43, in which the microphone cable 40 is caused to pass through in the metallic pipe 33, or may be applied to the portion in which the microphone cable 40 is caused to pass through in the flexible pipes 31 and 32.

According to this configuration, merely by applying the expandable ink materials 71 to the shield covered wire 43 and heating them, the condenser microphone in which the movement of the microphone cable 40 in the support pipe 30 is restricted, and thereby the generation of noise caused by looseness contact of the shield covered wire 43 is prevented can be manufactured with high productivity.

The present application is based on, and claims priority from, Japanese Application Serial Number JP2006-353719, filed Dec. 28, 2006 and JP2007-009847, filed Jan. 19, 2007, the disclosure of which is hereby incorporated by reference herein in its entirety.

The invention claimed is:

1. A condenser microphone comprising a condenser microphone unit and an output module section provided with a circuit board for producing sound signals in a shield case, the condenser microphone unit being supported on the output module section via a support pipe including a flexible pipe, and the condenser microphone unit and the circuit board being electrically connected to each other via a microphone cable having a shield covered wire inserted through the support pipe, wherein the microphone cable is inserted through the support pipe in a state in which the shield covered wire having no skin is exposed throughout the entire length thereof, and in a predetermined portion of the shield covered wire, an elastic linear body having fibers planted in the radial direction around a core wire and has elasticity in the radial direction due to the fibers is provided along the microphone cable, whereby the predetermined portion of the shield covered wire is pressed against the inner surface of the support pipe by the elastic linear body.

2. The condenser microphone according to claim 1, wherein the support pipe includes a nonflexible metallic pipe, the elastic linear body consists of a braid in which the core wire is formed of a wire material, and the braid is provided along the shield covered wire in a portion corresponding to the metallic pipe.

3. The condenser microphone according to claim 2, wherein the end part of the wire material is projected from at least one end of the braid, and the braid is attached to the predetermined position of the shield covered wire by winding the end part of the wire material on the shield covered wire.

4. The condenser microphone according to claim 1, wherein the elastic linear body consists of a braid yarn in which the core wire is a core yarn, and the braid yarn is provided along the shield covered wire throughout almost the entire length of the microphone cable.

5. The condenser microphone according to claim 1, wherein the fibers planted around the core wire have electric conductivity.

* * * * *